US011648636B2

(12) United States Patent
Toncelli et al.

(10) Patent No.: US 11,648,636 B2
(45) Date of Patent: May 16, 2023

(54) MACHINE AND METHOD FOR GRINDING AND/OR POLISHING SLABS OF STONE MATERIAL, SUCH AS NATURAL OR AGGLOMERATED STONE, CERAMIC AND GLASS

(71) Applicant: BRETON SPA, Castello di Godego (IT)

(72) Inventors: Luca Toncelli, Bassano del Grappa (IT); Michele Stangherlin, Castello di Godego (IT)

(73) Assignee: BRETON SPA, Castello di Godego (IT)

( * ) Notice: Subject to any disclaimer, the term of this patent is extended or adjusted under 35 U.S.C. 154(b) by 801 days.

(21) Appl. No.: 16/471,163

(22) PCT Filed: Dec. 20, 2017

(86) PCT No.: PCT/IB2017/058197
§ 371 (c)(1),
(2) Date: Jun. 19, 2019

(87) PCT Pub. No.: WO2018/116199
PCT Pub. Date: Jun. 28, 2018

(65) Prior Publication Data

US 2020/0016718 A1 Jan. 16, 2020

(30) Foreign Application Priority Data

Dec. 22, 2016 (IT) ..... 102016000130117

(51) Int. Cl.
*B24B 7/22* (2006.01)
*B24B 7/24* (2006.01)

(52) U.S. Cl.
CPC ..... *B24B 7/224* (2013.01); *B24B 7/241* (2013.01)

(58) Field of Classification Search
CPC ..... B24B 7/224; B24B 7/241; B24B 7/247; B24B 7/06; B24B 7/12; B24B 7/13;
(Continued)

(56) References Cited

U.S. PATENT DOCUMENTS 2,985,989 A * 5/1961 Knost ..... B24B 7/12 451/260
4,375,738 A 3/1983 Bando
(Continued)

FOREIGN PATENT DOCUMENTS

DE 102014009582 A1 1/2016
EP 2377646 A1 10/2011
(Continued)

OTHER PUBLICATIONS

PCT International Search Report and Written Opinion dated Apr. 12, 2018 for International Application No. PCT/IB2017/058197, from which the instant application is based, 9 pgs.

*Primary Examiner* — Joel D Crandall
*Assistant Examiner* — Michael A Gump
(74) *Attorney, Agent, or Firm* — Fredrikson & Byron, P.A.

(57) ABSTRACT

A grinding and/or polishing machine (10) for slabs of stone material, such as natural or agglomerated stone, ceramic or glass, comprises a support bench (12) for the slabs to be machined and at least one machining station (14) with a pair of bridge-like support structures (16, 18) arranged opposite each other with, above, a beam supporting a plurality of machining spindles (26). First relative movement means (19) move the slab in a longitudinal direction with respect to the machining station (14), while the beam moves transversely with respect to its length by means of second movement means (21). Each spindle is supported on the beam so that it can be swivelled by associated movement means (34, 35, 40, 50, 60) about an oscillation axis (33)
(Continued)

which is parallel to, but separate from the motorized vertical axis (32) of the spindle. The spindles thus oscillate about the respective oscillation axes (33) in cooperation with the longitudinal and transverse movements, respectively, of the first and second movement means (19 and 21) so as to polish and/or grind the surface of a slab on the support bench.

19 Claims, 4 Drawing Sheets

(58) Field of Classification Search
CPC .... B24B 7/14; B24B 7/20; B24B 7/24; B24B 7/248; B24B 7/242; B24B 7/244; B24B 27/0015; B24B 27/0023; B24B 27/0076; B24B 27/0069; B24B 27/00691; B24B 41/02; B24B 41/0475; B24B 41/005; B24B 47/10–18; B24B 37/345
USPC ..... 451/41, 130, 150, 159, 260
See application file for complete search history.

(56) References Cited

U.S. PATENT DOCUMENTS

| | | | | |
|---|---|---|---|---|
| 9,238,291 | B2 * | 1/2016 | Toncelli | B24B 41/0475 |
| 2009/0124180 | A1 | 5/2009 | Chacich | |
| 2017/0216988 | A1 * | 8/2017 | Toncelli | B24B 7/22 |

FOREIGN PATENT DOCUMENTS

| | | | | |
|---|---|---|---|---|
| KR | 20140010073 | A | 1/2014 | |
| TW | 592921 | B | 6/2004 | |
| WO | 2011064706 | A1 | 6/2011 | |
| WO | 2015087294 | A1 | 6/2015 | |
| WO | WO-2015087294 | A1 * | 6/2015 | B24B 27/0023 |

* cited by examiner

MACHINE AND METHOD FOR GRINDING AND/OR POLISHING SLABS OF STONE MATERIAL, SUCH AS NATURAL OR AGGLOMERATED STONE, CERAMIC AND GLASS

The present invention relates to a machine and a method for grinding and/or polishing slabs of stone material, such as natural or agglomerated stone, ceramic and glass.

RELATED APPLICATIONS

This application is a 35 U.S.C. 371 national stage filing from International Application No. PCT/IB2017/058197, filed Dec. 20, 2017, which claims priority to Italian Application No. 102016000130117, filed Dec. 22, 2016, the teachings of which are incorporated herein by reference.

This type of machine usually comprises a bench on which a conveyor belt for moving the slabs to be polished or ground travels in a longitudinal direction. Machines of this type further comprise two bridge-like support structures arranged straddling the bench, one on the entry side for the material to be machined and the other one on the exit side for the machined material. The two bridge-like structures support a spindle-carrying beam at its ends.

The spindle-carrying beam has, mounted thereon, a series of vertical-axis grinding and/or polishing spindles or heads which are arranged in a row and which have, mounted on their bottom end, tool holders which rotate about the vertical axis of the spindle and on which the abrasive tools are in turn mounted.

The spindle-carrying beam performs a reciprocating movement in a transverse direction so as to grind the slabs arranged on the conveyor belt over their entire width. The amount of the displacement varies depending on the width of the material being machined.

The tools used are made using hard granular materials such as normally silicon carbide or diamond. In industrial applications the abrasive granules usually are not used loose, but agglomerated so as to form an abrasive tool by means of a binding agent (which may be a cement, a resin, a ceramic material or a metal), which has the function of retaining the granules for as long as they perform their abrasive action, before breaking up and allowing them to fall once worn.

The abrasive tools, as mentioned above, are normally fixed to a tool holder which is rotated by a vertical-axis spindle.

In the case of soft stone materials, such as marble, the tool holder, which has a prismatic form with flat surfaces, is generally an abrasive-carrying plate.

In the case of hard stone materials, such as granite or quartz, the tool holder is generally a head which imparts a specific movement to the tools which are varyingly shaped and in any case arranged radially. The head may be of the type with oscillating holders (so-called oscillating-segment head) or rotating holders with a substantially horizontal axis for roller-shaped tools (so-called roller head) or rotating holders with a substantially vertical axis for flat tools (called disc head or also satellite or orbital head).

The tools furthermore have a grain size gradually decreasing (from a few hundred micrometres down to a few micrometres) as the slab passes below them. In particular, the first spindle which operates on the slab to be ground has tools with a relatively large grain size, the second spindle has tools with a grain size which is slightly smaller and so on, while tools with a very fine abrasive grain are mounted on the last spindle.

The spindle is slidable vertically and imparts to the tools resting on the surface of the material a pressure which may be of a mechanical, hydraulic or pneumatic nature; a pneumatic pressure is by far favoured and in this case the spindle—referred to as "plunger"—is slidable vertically, i.e. is operated by a pneumatic pressure.

This type of machine for grinding and polishing the surfaces of slabs must not be confused with machines, in some cases having a similar structure, used for machining the side edges of the slabs (for example in order to eliminate the sharp edges on glass sheets). For example the U.S. Pat. No. 4,375,738 describes a machine with a bridge structure which is able to operate with one head at a time solely on the side edges of the slabs in order to smooth them. Obviously, in these machines no problems arise with regard to possible lack of uniformity in the local machining of a surface, since operation is performed only along edges and corners.

In machines for grinding and/or polishing the surfaces of slabs, however, there exists the problem of obtaining a satisfactory uniformity of the surface in order to achieve an optimum aesthetic effect over the broad surface of the slab.

In this type of surface grinding and/or polishing machine, in fact, the spindles and, therefore, the grinding and/or polishing tools pause briefly when there is reversal in the movement over the broad surface being machined since the spindle-carrying beam moves with a rectilinear reciprocating motion transversely with respect to the direction of feeding of the material.

This brief pause results in a very slight localized depression in the material which is sufficient, however, to create visible shadow zones, in particular on the ground or polished surface of particularly delicate dark materials.

In an attempt to the solve this problem, different machines have therefore been devised, including that described in international patent application WO2011064706, which envisages a spindle-carrying beam and spindle-carrying structures rotating about a vertical axis on which the spindles are mounted in an eccentric position. In this type of machine in which the head is defined as being orbital, the relative movement of tool and slab is a combination of movements, i.e.:

- the reciprocating movement of the beam in the transverse direction;
- the longitudinal movement of the material underneath the beam;
- the rotation of the grinding/polishing head/plate mounted on the spindle;
- the revolving movement of the spindles about the axis of rotation of the spindle-carrying structure.

There exists moreover another type of machine in which a plurality of bridge structures, arranged transversely with respect to the bench, are provided. One or two grinding and/or polishing spindles travelling along the bridge structure are mounted on each bridge. In the case where there are two spindles per bridge structure, each spindle is movable independently in the transverse direction, namely each spindle is provided with its own drive, so that it may be moved independently along the bridge structure. Moreover, the bridge structures perform an orbital movement, being suspended on four connecting rods, so that the amplitude of the orbital movement is a few centimetres, equal to twice the length of the connecting rods.

In this type of machine, each tool is moved with a movement composed of:

- a rotational movement about the vertical axis of the spindle;

a reciprocating transverse displacement due to the movement of the spindle along the bridge;

an orbital movement due to the movement of the bridge produced by the suspension rods;

a continuous longitudinal displacement due to the feeding of the material on the bench.

The machines described above, while being widely used, are not without drawbacks.

In fact, although the trajectories of the machine tools described above, are sufficient to limit or avoid the aforementioned problems, said machine tools have an extremely complex design. In fact, in the first case, a structure for eccentrically supporting the spindles is provided, said technical solution complicating significantly the spindle movement mechanisms. In the second case, in an attempt to achieve uniformity in the surface machining of the slabs, each spindle is provided with a drive and has an independent movement, and therefore the system becomes very costly and complex.

In WO 2015/087294 it is also proposed mounting a plurality of spindles on the beam so that they are displaceable by a motor with a linear movement parallel to the length of the beam and in a manner synchronized with the reciprocating movement of the beam in the direction transverse to the length of the beam.

In this way the grinding and/or polishing tool-holder heads or plates perform the following movements:

a rotational movement about the vertical axis of the spindle;

a reciprocating, transverse, rectilinear movement due to the transverse displacement of the spindle-carrying beam;

a reciprocating, longitudinal, rectilinear movement due to the displacement of the spindles relative to the support bench; and a longitudinal translational movement due to the feeding of the slabs on the support bench.

Owing to interpolation of the transverse movements of the beam and the longitudinal movement of the spindles with controlled speeds it is possible to grind and/or polish in a uniform manner the slabs since the spindles are prevented from pausing too long on certain zones of the slabs to be ground, thus avoiding the aforementioned problems. The grinding action produced is more satisfactory, but the mechanical structure is relatively complex and delicate.

The general object of the invention is to overcome the drawbacks of the prior art by providing a machine which has a smaller degree of complexity and which is able to achieve an even more satisfactory result.

In view of this object the idea which has occurred is to provide, according to the invention, a grinding and/or polishing machine for slabs of stone material, such as natural or agglomerated stone, ceramic or glass, comprising: a support bench for the slabs to be machined; at least one machining station placed above the support bench and comprising at least one pair of bridge-like support structures situated in mutually opposite positions and transversely arranged straddling the support bench; first means for relative movement in the longitudinal direction of the machining station and the slab on the support bench; and at least one beam whose two ends are supported by said support structures; a plurality of spindles having a vertical sliding movement with motorized vertical axis and distributed along the beam; said beam being movable transversely on said support structures under the control of second movement means and at the bottom end of the spindle there being present at least one tool holder rotating with the motorized vertical axis of said spindle and carrying at least one abrasive tool for forming grinding and/or polishing heads; characterized in that at least one spindle is supported on the beam so that it can be swivelled about an oscillation axis which is parallel to, but separate from the motorized vertical axis of the spindle, third motorized means also being present for causing oscillation of the at least one spindle about the respective oscillation axis in cooperation with the transverse and longitudinal movements of the first and second movement means for grinding and/or polishing the surface of a slab on the support bench.

Still according to the invention the idea which has also occurred is to provide a method for grinding and/or polishing slabs by means of a plurality of spindles which perform a vertical sliding movement and are distributed along a beam, each spindle having a motorized vertical axis and tools rotating with this motorized vertical axis, comprising the steps of controlling in cooperation: a relative translational movement of slabs to be machined underneath the plurality of spindles in a direction parallel to the beam; a translational movement of the beam which is transverse to the extension of the beam; a reciprocating oscillating movement of the spindles on the beam, each about a respective oscillation axis which is parallel to, but separate from the motorized vertical axis of the spindle.

In order to illustrate more clearly the innovative principles of the present invention and its advantages compared to the prior art, a number of examples of embodiment applying these principles will be described below with the aid of the accompanying drawings. In the drawings.

Figure 1:
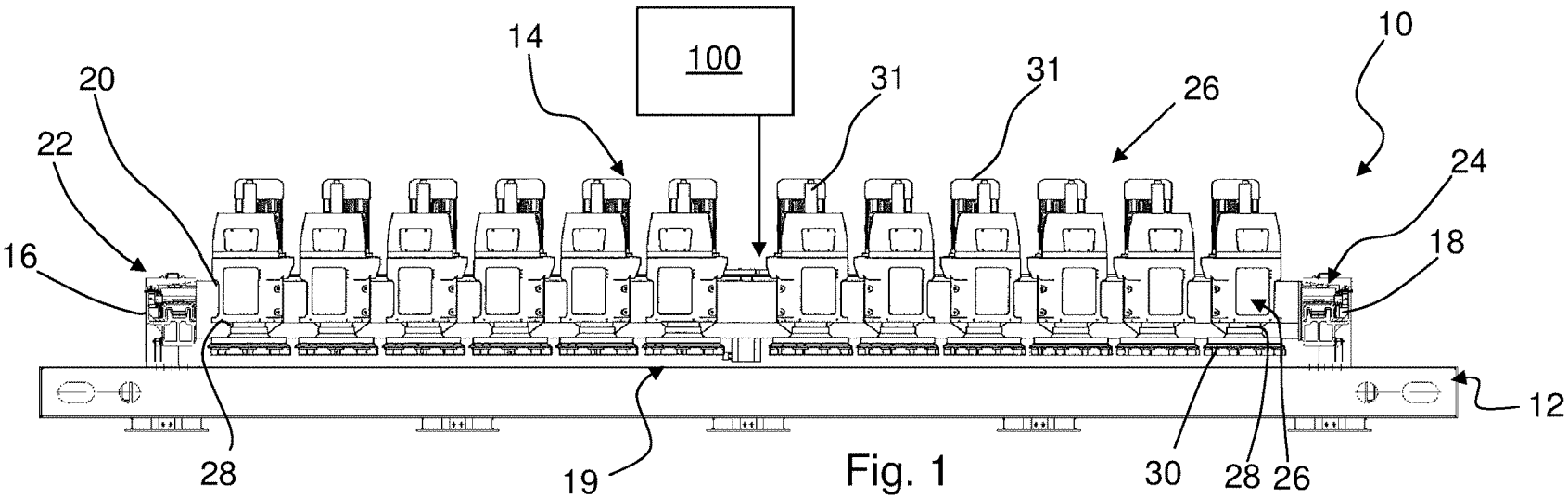
FIG. 1 shows a schematic front view of a grinding and/or polishing machine according to the present invention.

With reference to the figures, FIG. 1 shows a grinding and/or polishing machine for slabs of stone material, such as natural and agglomerated stone, ceramic or glass according to the present invention, indicated generally by the reference number 10.

The machine 10 comprises a support bench 12 for the slabs to be machined and, on top of it, at least one machining station 14.

The machining station 14 comprises at least one pair of bridge-like support structures 16, 18 situated opposite each other and arranged transversely straddling the support bench 12, and at least one beam 20, the two ends 22, 24 of which are supported by the support structures 16, 18. The beam 20 is movable in the transverse direction on the support structures 16, 18 over the entire transverse width of the working surface of the bench, namely the entire maximum width of a slab to be machined on the bench. Movement means 21 comprising a suitable drive cause displacement of the beam in the transverse direction. This drive may be advantageously formed by two motor units 21 arranged at the two ends of the beam and synchronized with each other.

The machine 10 further comprises means 19 for performing a relative movement of the slab (shown schematically in broken lines and indicated by 11) in the longitudinal direction (namely along the length of the beam) on the support bench 12 with respect to the machining station 14. In accordance with a preferred embodiment of the present invention, the first relative movement means 19 may consist of a conveyor belt 23 which causes feeding of the slab with a constant movement, mainly at a fixed speed, but optionally also at a variable speed with predefined criteria, usually related to the position of the moving beam. In accordance with alternative embodiments, the slabs may remain stationary with respect to the support bench 12, and the machining station 14 may be movable in the longitudinal direction from one end to the other of the support bench 14.

Owing to the said relative movement means 19 a slab being machined may move with a relative movement underneath the machining station over its entire length, entering at one end of the station and exiting from the opposite end and being subject to the action of all the machining heads over its entire surface.

A plurality of spindles are present on the beam 20. The spindles of the plurality are distributed along the beam and are provided with a motorized vertical axis 32 for rotation.

At least one tool holder 28 rotating about the axis of rotation 32 of the spindle and carrying at least one abrasive tool 30 is mounted on the bottom end of each spindle 26. Each spindle is advantageously provided with its own rotational motor 31 which causes rotation of the tool holder about the axis 32.

Grinding and/or polishing heads are thus formed.

Moreover, the spindles are also advantageously axially slidable in a controllable manner in the vertical direction. The sliding vertical axis allows, for example, raising of the heads at the end of machining and/or adjustment of the contact pressure of the heads on the slab being machined.

Preferably, the grinding and/or polishing spindles or heads are arranged in sequence on the beam in the longitudinal direction. Advantageously, the sequential heads have a grain size of the abrasive tool which gradually decreases in the direction of relative movement of the slab with respect to the station, so that the slab performing a slow relative movement is subject gradually to the action of tools with an increasingly finer grain size.

Figure 2:
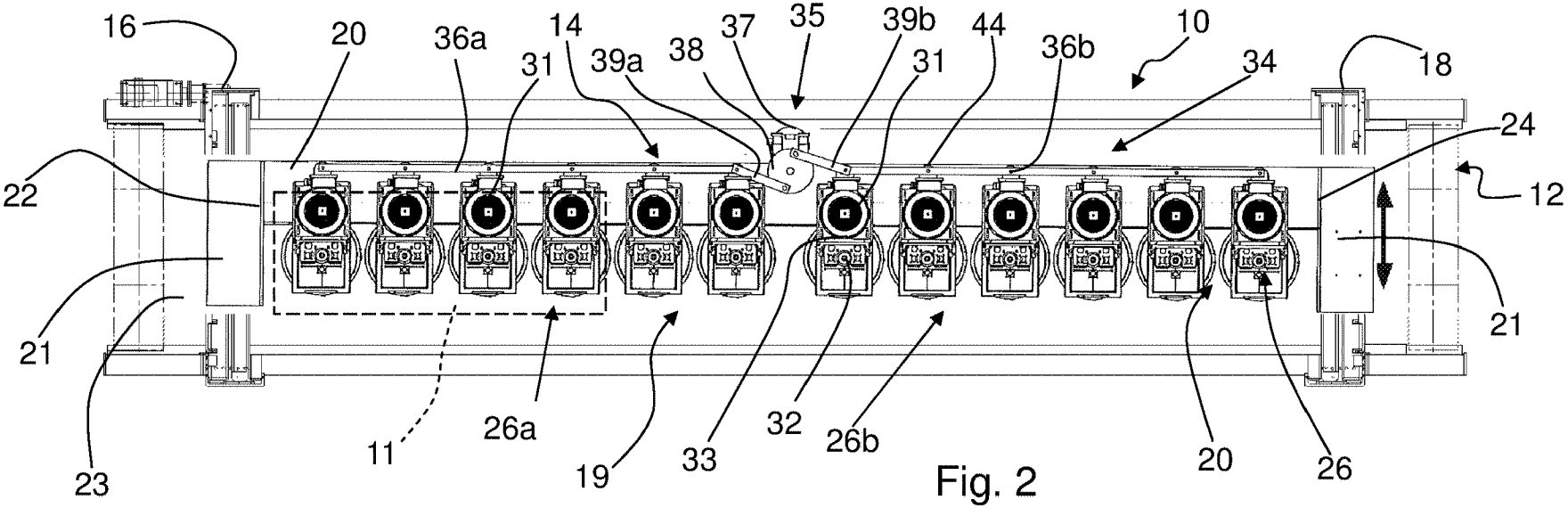
FIG. 2 shows a schematic view, from above, of a grinding and/or polishing machine according to the present invention.

In the embodiment shown in FIGS. 1 and 2, for example twelve heads or spindles 26, provided with a tool-holder support 28 for oscillating tools, are mounted on the beam. In accordance with alternative embodiments of the present invention, the tool holder 28 (or machining head) may be provided with other tools, as described in the introductory part of the present description, again in order to perform machining operations on the upper surface of the slab.

According to the principles of the invention at least one spindle 26, and preferably each spindle 26, is supported on the beam 26 also so as to be able to perform a swivelling movement, in a controllable manner, about a vertical axis 33 parallel to, but separate from the vertical axis 32 of rotation of the tool holder 28. Advantageously the axis 32 and the axis 33 are arranged in a vertical plane transverse to the length of the beam 20.

Motorized movement means 34 cause oscillation of the spindles about the axis 33 so that the axis 32 may perform a limited circle arc movement about the axis 33, as will be clarified below.

Figure 3:
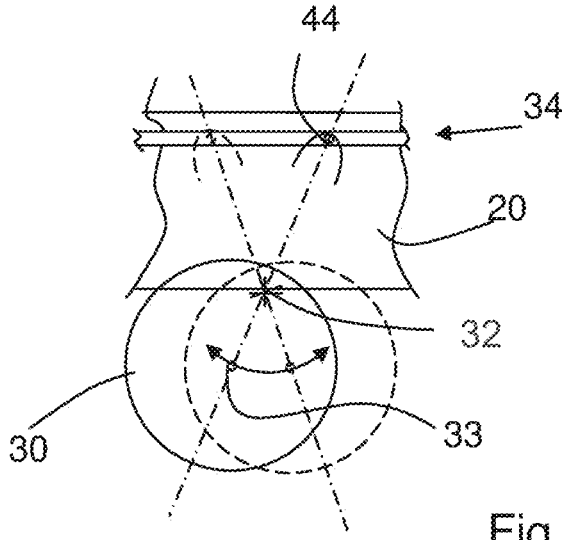
FIG. 3 shows a schematic plan view of a movement of a spindle according to the invention.

This is also shown schematically in FIG. 3, for one of the spindles 26. This figures also shows in solid lines one end of the oscillation and in broken lines the other end of the oscillation. The maximum angle of oscillation may be for example between 20° and 45°. A typical angle of maximum oscillation may be in the region of 30°.

It should be noted that, with a variation in the angle of oscillation, the amplitude of the movement of the spindles in the longitudinal direction also varies.

The amplitude of the movement of the spindles in the longitudinal direction may be for example of the order of a few cm (for example, 2 to 10 cm and preferably 3 to 7 cm).

Figure 6:
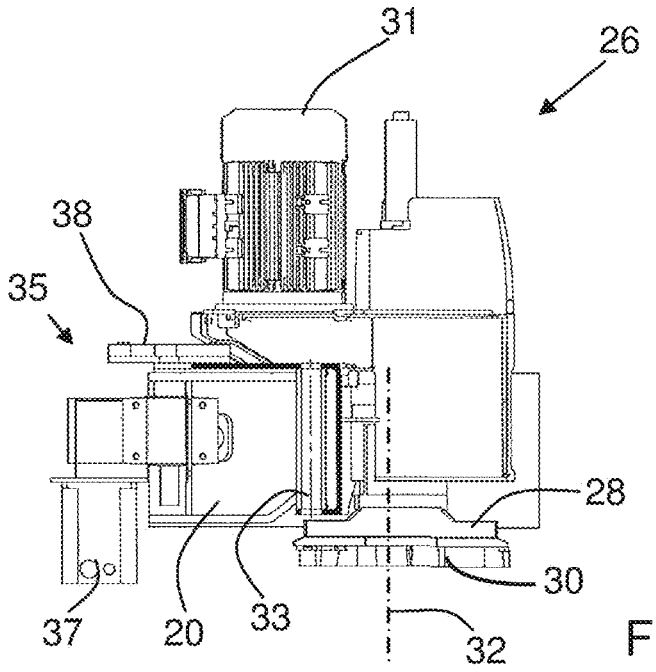
FIG. 6 shows a side view of a spindle of the embodiment shown in FIG. 1 on its support beam.
Figure 7:
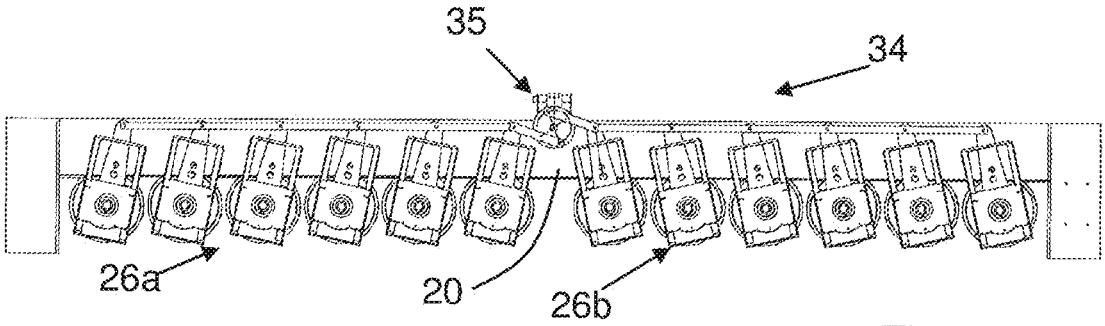
FIGS. 7 and 8 shows schematic plan views of possible movements of the spindles of a machine according to the invention.
Figure 8:
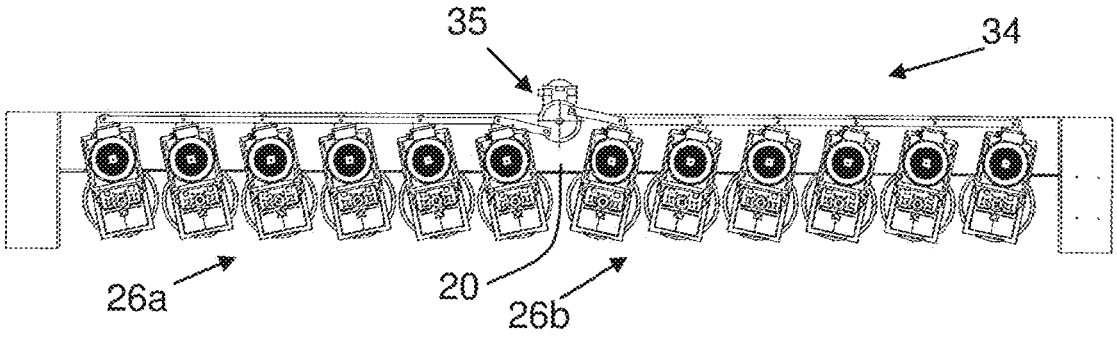

FIG. 6 also shows the side view of a spindle with the relative positions of the two axes 32, 33.

The motorized movement means 34, designed to swivel controllably the spindle about the axis 33, allow the spindle to move alternately in the two directions through the predefined angle of rotation.

Basically, starting from a position in which the rotational arm is arranged perpendicularly with respect to the beam (which may be defined "central position"), the spindles may be made to rotate or oscillate alternately in one direction and in the opposite direction about the central position.

Advantageously, the oscillation movement of the spindles about the respective oscillation axes cooperates with the longitudinal and transverse movements, respectively, of the first and second movement means 19 and 21 so as to polish and/or grind the surface of a slab on the support bench.

For the purposes of cooperation a control unit 100 may be advantageously provided. This may be, for example, a system known per se of the type with suitably programmed microprocessor which is able to control operation of the various drives for longitudinal displacement of the slabs underneath the machining station, the transverse movement of the beam and the oscillation of the spindles about the respective axes 33. These movements may be suitably synchronized as will become clear below in order to machine uniformly the entire surface of the slabs.

The movement means 34 for oscillation of the spindles may be designed so that the spindles can be swivelled individually, or preferably in groups, or altogether at the same time. Advantageously, the motorized oscillation means 34 may operate on one end 44 of each spindle which is opposite to the motorized axis 32 of the spindle relative to the oscillation axis 33.

In particular there may be two limit solutions as follows:

- each spindle is moved autonomously and independently of the other spindles so that each spindle has its own drive;
- all the spindles are moved together so that there is a single drive.

For example, in the first embodiment described with reference to FIGS. 1 to 8, the spindles are divided into two groups 26*a* and 26*b* (preferably, but not necessarily having the same number of spindles) and, in order to form the movement means 34, a drive 35 which operates these two groups with an opposite reciprocating movement is provided. In this way the spindles of one group oscillate in counter-phase with respect to the spindles of the other group.

For the simultaneous operation of the spindles in each group, a movement rod, i.e. 36*a* and 36*b*, may be provided for each group 26*a* and 26*b*, as can be clearly seen for example in FIG. 2. The two movement rods may be moved by a single drive 35 which is located in the centre of the beam between the two spindle groups.

Figure 4:
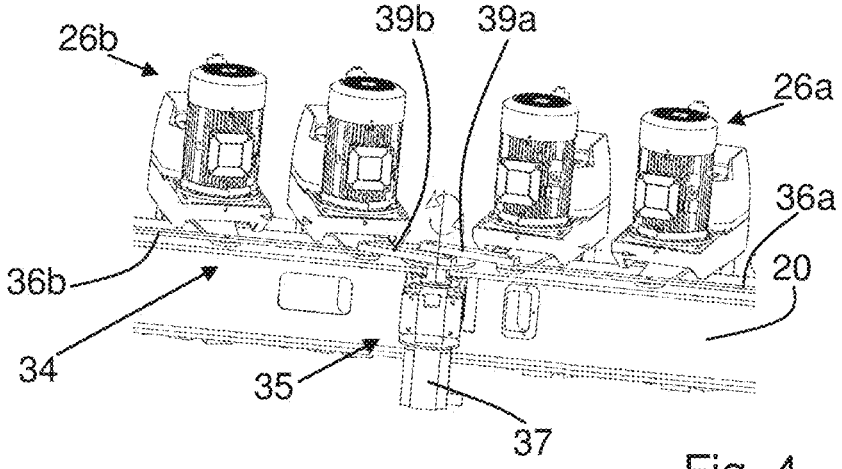
FIGS. 4 and 5 show partial, schematic, perspective views of a part of the machine according to FIG. 1.
Figure 5:
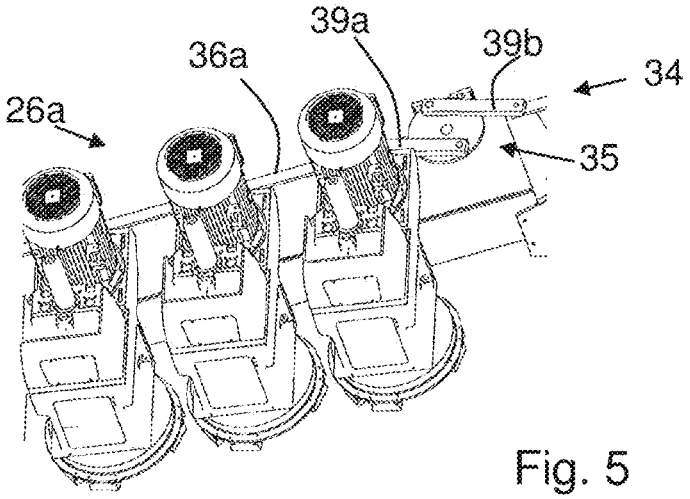

As can be clearly seen also in FIGS. 4 and 5, the drive comprises a gearmotor 37 (for example with brushless motor) and a disc 38 is keyed onto the gearmotor shaft and therefore made to rotate. Two connecting rods 39*a*, 39*b*, each connected to one of the two movement rods 36*a*, 36*b*, are joined to the rotating disc (which acts as a crank).

A connecting rod/crank mechanism is thus provided.

As can be noted from the figures, the drive shaft and therefore the rotating disc 38 are not rotated continuously, but are made to oscillate, namely first they rotate in one direction and then they rotate in the opposite direction through the predefined angle of rotation. This is visible for example in FIGS. 7 and 8 (in FIG. 7 the upper motors of the spindles have been removed for greater clarity).

It should be noted that, when there is a variation in the angle of rotation or rather the oscillation of the drive shaft and therefore the rotating disc, the amplitude of the movement of the spindles in the longitudinal direction varies.

Figure 9:
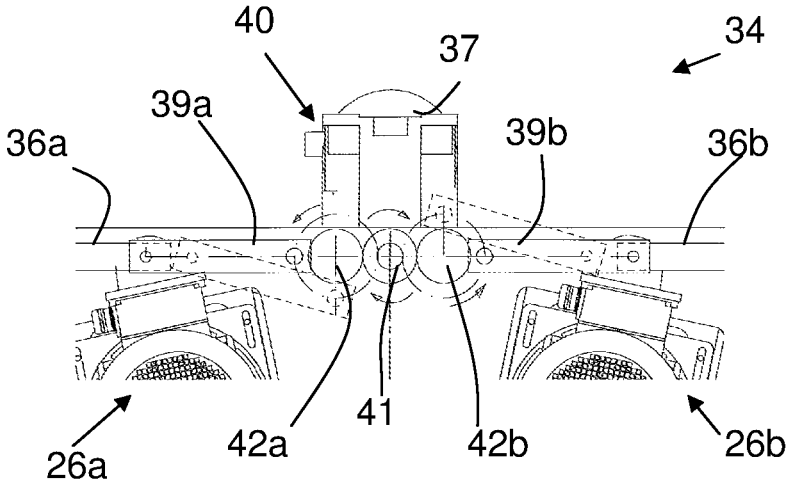
FIG. 9 shows a schematic plan view of a possible first variation of embodiment of a machine according to the invention.

FIG. 9 shows in schematic form a possible constructional variant for operating the two rods 36*a* and 36*b* via a different drive 40. The two rods always operate the two groups of spindles 26*a* and 26*b*.

The drive 40 is again located in the centre, but differs from the preceding solution as regards the rod movement mechanism.

A pinion 41 with which two gearwheels 42*a*, 42*b* mesh on opposite sides is in fact keyed onto the drive shaft of the gearmotor 37.

A rotating disc (which acts as a crank) is coaxially mounted on each of the two gearwheels and has, mounted on it, the respective connecting rod 39*a*, 39*b* which is connected to the corresponding movement rod 36*a*, 36*b*.

Differently from the first solution, the drive shaft and therefore the pinion, the two gearwheels and the two rotating discs may be rotated continuously. This simplifies the electronic control of the motor.

In the event of continuous rotation, the amplitude of the movement of the spindles in the longitudinal direction depends on the diameter of the circle traced by the hinging point of the connecting rod with the rotating disc. The two groups of spindles swivel in any case backwards and forwards about the hinging axis 33, in a similar manner to that shown in FIGS. 7 and 8 for the preceding embodiment.

It may be now easily imagined by the person skilled in the art how each gearwheel 42*a* and 42*b* may also be operated by an associated gearmotor, so that each group of spindles may oscillate independently of the other one, even though if necessary synchronized by means of suitable electronic control of the unit 100.

Figure 10:
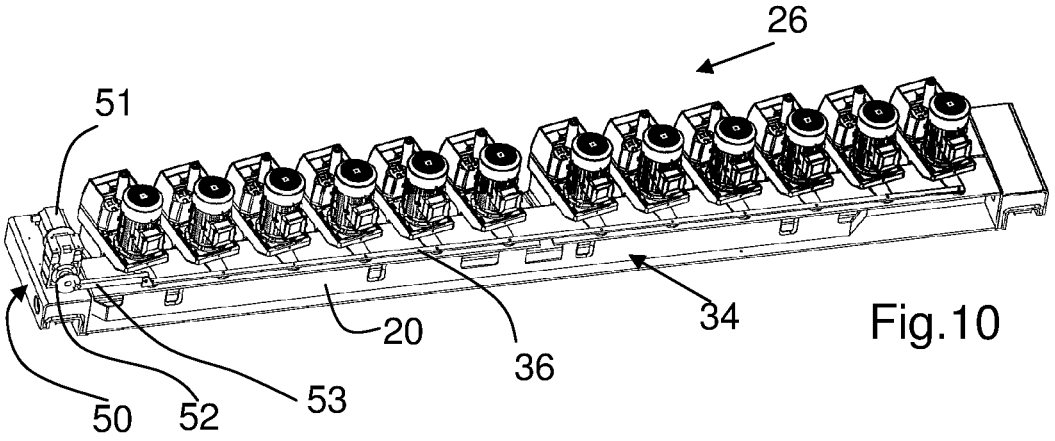
FIG. 10 shows a schematic perspective view of a possible second variation of embodiment of a machine according to the invention.

FIG. 10 shows in schematic form a further possible variation of embodiment in which the motorized means 34 comprise a single rod 36 which moves simultaneously all the spindles 26.

As can be noted from FIG. 10, all the spindles are constrained to the single movement rod 36 which is connected with its end to a drive 50 located at one end of the beam 20. The drive 50 comprises a gearmotor 51, the drive shaft of which causes rotation of a rotating disc 52 (which acts as a crank) which is connected to a connecting rod 53, the end of which is connected to the movement rod 36.

In this case also, the motor may rotate continuously and always in the same direction so as to cause backwards and forwards oscillation of the spindles. The amplitude of the movement in the longitudinal direction is therefore a function of twice the hinging distance of the connecting rod on the rotating disc. For example, the amplitude is equal to twice the hinging distance of the connecting rod on the rotating disc if the distance between the oscillation axis 33 and the axis 32 is equal to the distance between the oscillation axis 33 and the pivoting point of the rod 36 on the movement end 44 of the spindle.

It is nevertheless clear now that the movement rod could also be operated by two synchronous drives arranged at the two ends of the beam, so as to divide up the force.

Figure 11:
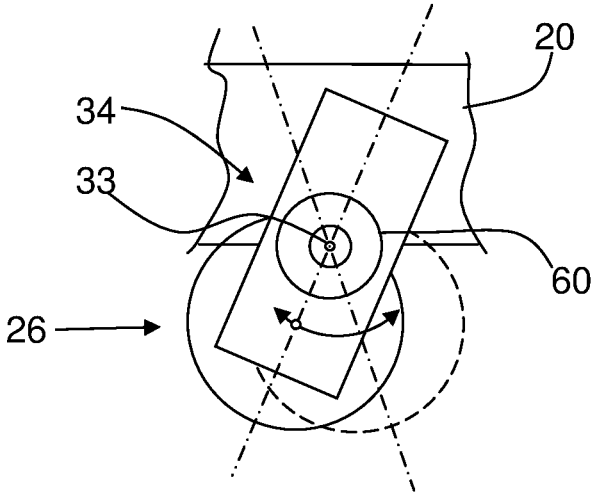
FIG. 11 shows a schematic plan view of a possible third variation of embodiment of a machine according to the invention.

FIG. 11 shows in schematic form a variation of embodiment of the spindles whereby, in order to obtain the movement means 34, each spindle has a gearmotor 60 which may oscillate the spindle about the axis of rotation 33. Obviously, in the case of single drives for each spindle, the oscillations must be synchronized in order to prevent impacts between adjacent spindles, or the adjacent spindles must be spaced from each other sufficiently to prevent impacts when moved in counter-phase (this may be seen for example in the case of the two adjacent spindles of the two groups shown in FIG. 8).

It has been found that, by causing oscillation of the spindles through a small circle arc in a direction substantially parallel to the beam while the beam is moved transversely with respect to the slab and the slab travels underneath the spindles, it is possible to obtain a grinding action with a signification reduction in the grinding defects while keeping the movement structure of the machine simple. In particular, the circle-arc movement of the machining heads, with even only a few centimetres of amplitude in the longitudinal direction, results in a significant reduction of the shadow effects due to grinding and polishing, also in the case of dark materials and/or relatively difficult machining, for example involving slabs of stone material, such as natural or agglomerated stone.

This is due also to the fact that there is an asymmetry in the movement of the spindles due to the fact that the spindles are not moved in linear fashion in the longitudinal direction of the beam, but are moved by means of oscillation about their hinging pivot on the beam. The movement or the trajectory described by the spindles therefore is not rectilinear and longitudinal, but occurs along a circle arc. The structure of the pivoting system of the spindles and the machine however allows an amplitude of movement of the spindles on the beam which is much greater in the longitudinal direction than the amplitude of the transverse movement due to the circle-arc movement. This has been found to be optimal for preventing shadow effects while keeping at the same time the machine structure simple.

The asymmetry of the movement depends naturally on the degree of curvature of the circle arc described by the trajectory of the spindles and is therefore dependent on:

- the distance between the hinging pivot of the spindle on the beam and the axis of rotation of the spindle shaft (a few centimetres);
- the angular amplitude of oscillation of the spindle.

The greater the distance between the hinging pivot of the spindle on the beam and the axis of rotation of the spindle shaft and the smaller the angular amplitude of oscillation of the spindle, the smaller will be the deviation of the circle-arc trajectory from a rectilinear path.

The amplitude of the longitudinal movement of the spindles and therefore the angle of oscillation of the rotating disc may be adjusted depending on the type of material, the machining quality and the type of tools. By carrying out a few tests the person skilled in the art may easily find the best combination, owing to the constructional and operational simplicity of a machine according to the invention.

The amplitude of the movement of the spindles in the longitudinal direction may be for example of the order of a few cm (for example, 2 to 10 cm and preferably 3 to 7 cm).

The machine may operate easily in different ways

The control system 100 of the machine is in fact able to control:

- the reciprocating movement of the beam in the transverse direction;
- the oscillating rotational movement of the spindles, differentiating where necessary also the movement of one group of spindles from that of the other group if the spindles are divided up into several groups (or, at least, the oscillating movement of each spindle from that of the other spindles);
- the feeding movement of the belt on which the slabs are resting.

In addition, the control system may also control the axial movement of the spindle (plunger action), so as to ensure the contact of the abrasive tools, with the desired operating pressure, against the surface of the slab depending on the shape of the slab detected for example by a suitable known device for reading its perimeter (it is evident that the tool-holder head must descend over the slab when it passes by and not over the conveyor belt in the gap between one slab and the adjacent slabs).

In particular, the control system is able to control in a synchronized manner the various abovementioned movements in order to obtain various trajectories, including complex ones, of the machining tools over the surface of the slab, depending on its shape.

As a result it is possible to obtain precise interpolation of the various movements with controlled speeds, thus obtaining slabs which are uniformly ground because the spindles are prevented from pausing for different durations in given zones of the surfaces of the slabs to be ground, eliminating the possibility that defects visible to the naked eye arise even when viewing the slab against the light.

The speed of displacement of the beam and the speed of oscillation of the spindles may be adjusted by the control system in an interpolated manner, so as to obtain particular trajectories resulting from the combination of the two movements.

The speed of travel along the trajectories may be constant or preferably adjustable and programmable so as to vary the time the tools remain in different zones of the slab.

As may be now easily imagined by the person skilled in the art, different closed trajectories may be defined without stoppage points or sudden and quick reversal points, eliminating the drawbacks referred to above.

It is also possible to simulate with ease the trajectories possible with the more complex machines which perform both transverse and longitudinal rectilinear movements, such as the machine described in the already mentioned patent WO2015/087294.

At this point it is clear how the objects of the invention have been achieved. Owing to the structure with oscillating-arc movement of the spindles together with the linear movement in two perpendicular directions, polishing and grinding may be performed without the creation of shadow effects, despite the constructional and operational simplicity of the machine according to the invention.

The control unit (known per se, for example a suitable programmable industrial controller) may control in a synchronized manner the various movements so as to obtain complex trajectories of the machining tools on the slabs being machined. For a precise synchronized control, the movement means may obviously also comprise a feedback control system, with suitable position sensors, such as incremental or related encoders, as may be easily imagined by the person skilled in the art.

The machine according to the invention may obtain optimum results also similar to those of the more complex machines which have several movements to be synchronized and interpolated.

Owing to the simplicity of the structure it possible to obtain a large number of heads on the beam, while maintaining simple control of their synchronized movement.

Obviously the description given above of embodiments applying the innovative principles of the present invention is provided by way of example of these innovative principles and must therefore not be regarded as limiting the scope of the rights claimed herein. During the specific implementation of the characteristic features of the present invention only some of the functions or devices described above may be chosen and combined together or, on the other hand, also other known slab machining systems may be incorporated based on the principles of the invention.

For example, as already mentioned above, the control system may also comprise a feedback subsystem provided with suitable sensors (e.g. encoders) for a better control of the synchronized movements, as may be easily imagined by the person skilled in the art.

The belt and therefore the slabs underneath the machining spindles may advance at a constant speed or at a variable speed synchronized with the speed of displacement of the beam, as considered preferable.

It is also possible to divide the spindles into more than two groups, for example by suitably dividing the movement rod into segments and providing a drive or movement mechanism for each segment.

In the embodiments illustrated above by way of example, the drive comprises usually a connecting rod/crank mechanism. It is understood, however, that other types of mechanisms are possible, as may be now easily imagined by the person skilled in the art.

For example, linear motors, or rack and pinion mechanisms or toothed belt systems, or pressure cylinders, etc., could be used.

The speed of displacement of the various movements of the machine may be constant or may vary depending on predetermined programmed laws, so as to be able to provide specific trajectories for the grinding heads with a combination of the various linear and curved movements.

In any case it is possible to achieve easily closed trajectories of the machining heads without pausing or reversal points which could give rise to undesirable shadow effects on the surface of the slabs.

The invention claimed is:

1. A machine for one or more of grinding and polishing slabs of stone material, such as natural or agglomerated stone, ceramic or glass, comprising:

- a support bench for the slabs to be machined;
- at least one machining station placed above the support bench and comprising at least one pair of bridge-like support structures situated in mutually opposite positions and transversely arranged straddling the support bench,
- first means for relative movement in a longitudinal direction of the machining station and one of the slabs on the support bench, and at least one beam whose two ends are supported by said support structures; and
- a plurality of spindles having a vertical sliding movement with a motorized vertical axis of rotation and distributed along the beam;

said beam longitudinally extending in a direction parallel to the longitudinal direction and being movable along a transverse direction on said support structures by means of second movement means and at the bottom end of each spindle there being present at least one tool holder rotating with the motorized vertical axis of said spindle and carrying at least one abrasive tool for forming one or more of grinding and polishing heads;

characterized in that each of the spindles is supported on the beam so as to be swiveled about an oscillation axis which is parallel to, but separate from the motorized vertical axis of the corresponding spindles, and further comprising a third motorized means for causing oscillation of each of the spindles about the respective oscillation axis in cooperation with transverse and longitudinal movements of the first and second movement means for one or more of grinding and polishing surfaces of the slabs on the support bench; and wherein the third motorized means causes oscillation of each of the spindles about the respective oscillation axis so that the motorized vertical axes can perform limited circle arc movements about their oscillation axes.

2. The machine according to claim 1, characterized in that the respective oscillation axis and the respective motorized vertical axis are contained in a plane which, in an intermediate position of the swiveling about the axis of oscillation, is transverse to an extension of the beam.

3. The machine according to claim 2, characterized in that the spindles are divided into two groups along the beam, the spindles of each group being connected to the third motorized means so as to oscillate in counter-phase with respect to the spindles of the other group.

4. The machine according to claim 1, characterized in that the third motorized means comprises at least one movement rod which is connected on one side to one end of one of the spindles to be oscillated and on the other side to a motorized connecting rod/crank mechanism, wherein the connecting rod/crank mechanism is arranged on the beam between two groups of the spindles for actuating the two groups of spindles by means of a movement rod for each of the groups.

5. The machine according to claim 4, characterized in that the spindles are divided into the two groups along the beam, the spindles of each group being connected to the third motorized means so as to oscillate in counter-phase with respect to the spindles of the other group.

6. The machine according to claim 1, characterized in that the spindles are divided into two groups along the beam, the spindles of one of the groups being connected to the third motorized means so as to oscillate in counter-phase with respect to the spindles of the other of the groups.

7. The machine according to claim 1, characterized in that the swiveling has an amplitude of rotation about the oscillation axis which is between 10 and 45 degrees.

8. The machine according to claim 7, characterized in that the amplitude of rotation about the oscillation axis of the swiveling is equal to about a maximum of 30 degrees.

9. The machine according to claim 1, characterized in that an amplitude of movement of the spindles in the longitudinal direction produced by the swiveling about the oscillation axis is between 2 and 10 cm.

10. The machine according to claim 9, characterized in that the amplitude of the movement of the spindles in the longitudinal direction produced by the swiveling about the oscillation axis is between 3 and 7 cm.

11. The machine according to claim 1, characterized in that, for cooperation of said movements with the oscillation, a control unit is provided, said control unit being able to interpolate at least a reciprocating movement in the transverse direction of the beam and the swiveling so as to achieve predetermined closed trajectories for the one or more grinding and polishing heads.

12. The machine according to claim 1, characterized in that said first means for relative movement comprises a conveyor belt.

13. The machine according to claim 1, wherein the motorized vertical axis and the oscillation axis of each spindle are arranged in a vertical plane transverse to a length of the beam.

14. A method for one or more of grinding and polishing slabs by means of a plurality of spindles having a vertical sliding movement and distributed along a beam, each of the spindles having a motorized vertical axis and tools rotating with the motorized vertical axis, comprising the steps of controlling in cooperation:

moving the slabs to be machined with a relative translational movement underneath the plurality of spindles in a direction parallel to a longitudinal direction of the beam;

moving the beam translationally in a direction transverse to an extension of the beam; and moving the spindles on the beam so as to have reciprocating oscillation, whereby each of the spindles oscillates about a respective oscillation axis which is parallel to, but separate from the motorized vertical axis of the corresponding spindles, wherein a separate movement means causes each of the spindles to oscillate about the respective oscillation axis so that the motorized vertical axes can perform limited circle arc movements about their oscillation axes.

15. The method according to claim 14, characterized in that a swiveling movement of the spindles has an amplitude of rotation about the oscillation axis which is between 10 and 45 degrees.

16. The method according to claim 15, characterized in that the amplitude of rotation about the oscillation axis of the swiveling is equal to about a maximum of 30 degrees.

17. The method according to claim 14, characterized in that an amplitude of the movement of the spindles in the longitudinal direction produced by a swiveling movement of the spindles about the oscillation axis is between 2 and 10 cm.

18. The method according to claim 17, characterized in that the amplitude of the movement of the spindles in the longitudinal direction produced by the swiveling about the oscillation axis is between 3 and 7 cm.

19. The method according to claim 14, wherein the motorized vertical axis and the oscillation axis of each spindle are arranged in a vertical plane transverse to the extension of the beam.

* * * * *